US005312060A

United States Patent [19]

Neri

[11] Patent Number: 5,312,060

[45] Date of Patent: May 17, 1994

[54] DEVICE FOR FEEDING REELS INTO A PACKAGING MACHINE

[75] Inventor: Armando Neri, Bologna, Italy

[73] Assignee: G.D. S.p.A., Bologna, Italy

[21] Appl. No.: 706,503

[22] Filed: May 28, 1991

[30] Foreign Application Priority Data

Jun. 11, 1990 [IT] Italy ..... 3547 A/90

[51] Int. Cl.[5] ..... B65H 19/30

[52] U.S. Cl. ..... 242/58.6; 198/531; 414/911

[58] Field of Search ..... 242/58, 58.6; 198/531, 198/535; 414/746.4, 911

[56] References Cited

U.S. PATENT DOCUMENTS

| | | | |
|---|---|---|---|
| 2,389,443 | 11/1945 | Lyle | 242/58.6 |
| 3,667,621 | 6/1972 | Barlow | 414/746.4 X |
| 3,977,617 | 8/1976 | Salmon | 242/58 X |
| 4,298,173 | 11/1981 | Johansson | 242/58 |
| 4,386,741 | 6/1983 | Weiss et al. | 242/58.6 |
| 4,575,018 | 3/1986 | Ichikawa | 242/58 X |
| 4,767,076 | 8/1988 | Tagawa | 242/58.6 |
| 4,840,321 | 6/1989 | Focke et al. | 242/58.6 |
| 4,905,925 | 3/1990 | Kremar | 242/58.6 X |
| 5,169,273 | 12/1992 | Kawamura | 414/911 X |

*Primary Examiner*—Daniel P. Stodola
*Assistant Examiner*—John Rollins
*Attorney, Agent, or Firm*—Guido Modiano; Albert Josif

[57] ABSTRACT

The device for feeding reels into a packaging machine comprises a buffer magazine for the reels. The reels are advanced one after the other along the magazine by a conveyor belt provided with pairs of uniformly spaced teeth for supporting individual reels. A distribution element, comprising a supporting element and a resiliently urged tape, guides a first one of the reels into a removal position, and a transfer device transfers the reels sequentially from the removal position, through a reel guiding channel, to an underlying receiving position, at which a device operates for changing the reel to be unrolled in the packaging machine.

7 Claims, 4 Drawing Sheets

DEVICE FOR FEEDING REELS INTO A PACKAGING MACHINE

BACKGROUND OF THE INVENTION

The present invention relates to a device for feeding reels of tape material into a packaging machine.

In particular, the present invention relates to a device for feeding reels of wrapping material loaded in the buffer magazine of a machine which uses said tape material for wrapping or packaging.

Packaging machines are known which have a buffer magazine suitable for supporting a plurality of reels arranged side by side. The reels to be used are removed one at a time from said buffer magazine and are fed to elements which change said reels in the packaging machine.

When the reel being used ends, said changing elements feed the machine with a subsequent reel. This makes the packaging machine independent for relatively long periods of time.

A changing device used in said machines is described in the U.S. Ser. No. 07/619.476 filed Nov. 29, 1990, now U.S. Pat. No. 5,219,127. Said changing device essentially provides a transfer element which can move between a first position, in which it receives the reel to be transferred to the packaging machine, and a second position for the normal unrolling of the reel in the machine; said transfer element comprises a rotatable arm which is provided, at one end, with a reelholder head.

In order to reduce the dimensions of the unit, the reel buffer magazine is preferably arranged in a region overlying the packaging machine.

Therefore the problem arises of removing the reels loaded in the buffer magazine and feeding said reels in succession to the reel changing device of the packaging machine.

Automated feeding systems are currently known for this purpose, but they are rather complicated and relatively expensive.

SUMMARY OF THE INVENTION

The aim of the present invention is to solve the above described problem by means of a device which allows to remove, in a simplified manner, the reels loaded in the buffer magazine and to feed said reels to a reel changing device in a packaging machine.

An object of the present invention is to provide a device which has reduced dimensions, is safely reliable in operation and is versatile in use.

This aim and object, as well as other objects which will become apparent hereinafter, are both achieved by the present device for feeding reels into a packaging machine, characterized in that it comprises a buffer magazine for said reels, along which said reels are advanced after one another; distribution means for guiding a first one of said reels into a removal position; transfer means for transferring said reels, one after the other, from said removal position to an underlying receiving position, at which a device operates for changing the reel to be unrolled in the packaging machine.

BRIEF DESCRIPTION OF THE DRAWINGS

The advantages and characteristics of the invention will become apparent from the detailed description of a preferred embodiment of the device for feeding reels into a packaging machine, illustrated only by way of non-limitative example in the accompanying drawings, wherein.

DESCRIPTION OF THE PREFERRED EMBODIMENTS

Figure 1:
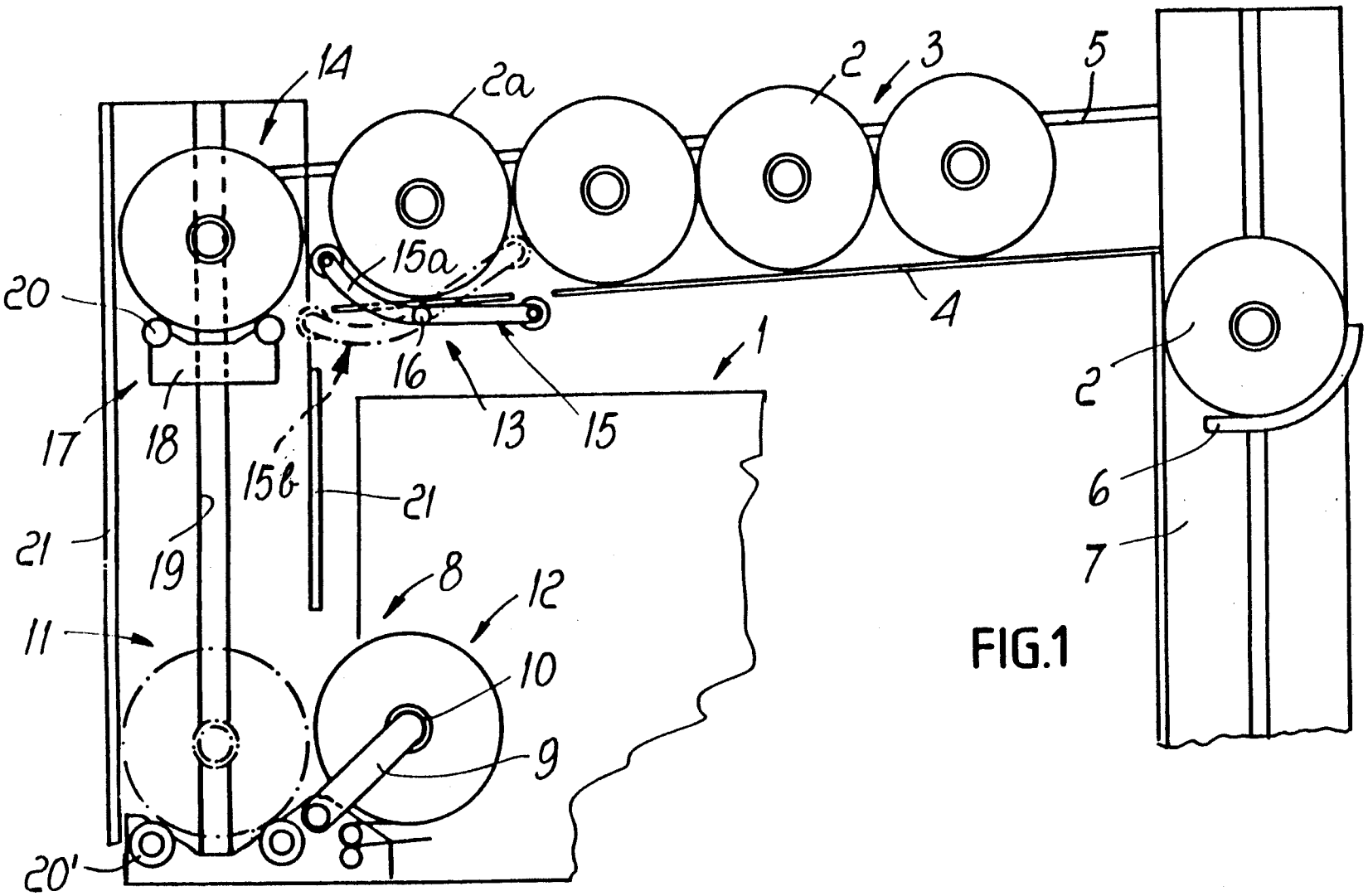
FIG. 1 is an elevation view of a packaging machine provided with the feeding device according to the invention.

With reference initially to FIG. 1, the reference numeral 1 generally indicates a packaging machine which uses reels 2 of tape material. A buffer magazine 3 is arranged above the packaging machine 1 and is adapted for containing a plurality of reels 2 which are arranged after one another in series with their axes arranged horizontally and parallel to one another and with their flat faces arranged substantially co-planar.

The bottom of the magazine 3 is constituted by an inclined plane 4 which allows the descent of the reels 2 by gravity. Said reels 2 are furthermore guided by lateral shoulders 5, only one of which is illustrated in FIG. 1.

The reels 2 are loaded into the buffer magazine 3 by means of a loading device which is arranged at the inlet of said magazine 3. Said loading device comprises a lifting element 6 which is adapted for moving the reel 2 to be loaded to the entry region of the magazine 3; the lifting element 6 can move along a post 7 which is provided with means for guiding the reel 2.

The device for feeding the reels 2 to an underlying reel changing device generally indicated by the reference numeral 8 is arranged at the outlet of the buffer magazine 3.

The reel changing device 8 is preferably of the type illustrated in the U.S. Ser. No. 07/619.476 filed Nov. 29, 1990, now U.S. Pat. No. 5,219,127; said device has an arm 9 which is provided, at one end, with a reel-holder head 10 and is rotatable between a first position 11, in which it receives the reel 2 to be transferred to the packaging machine 1, and a second position 12, for the normal unrolling of the reel 2 in said packaging machine 1.

The device for feeding the reels 2 comprises distribution means 13 suitable for guiding the first one **2*a* of the reels 2 contained in the magazine 3 into a removal position 14**.

Said distribution means 13 are constituted by a distribution element 15 which oscillates, under the control of actuation elements which are not illustrated, about a fulcrum 16 the axis whereof is perpendicular to the vertical plane of the magazine 3. The distribution element 15 is arranged so as to continue the inclined plane 4 and has a front portion **15*a* shaped so as to retain the first reel 2*a*** of the row.

The distribution element 15 is rotatable between a first position, wherein it retains the first reel **2*a* of the row, and a second position, indicated by the broken lines 15*b*, wherein it allows said reel 2*a* to descend to the removal position 14**, retaining the subsequent reel of the row.

Transfer means, generally indicated by the reference numeral 17, are arranged downstream of the distribution means 13 and are suitable for sequentially transferring, one after the other, the reels 2 from said removal position 14 to the underlying receiving position 11.

Said transfer means 17 have a reel supporting element 18 which is movable along a vertical guide 19 under the control of conventional actuation means which are not illustrated. The supporting element 18 is constituted by a pair of bars 20 which protrude transversely to the guide 19; said bars 20 are adapted for carrying the reel 2 so as to rest it on a pair of rollers 20' provided on the reel changing device 8 in the receiving position 11.

The reel 2 is furthermore guided, during transfer, between a pair of opposite walls 21 which are parallel to the guide 19 and face the peripheral surface of the reel 2.

The operation of the device according to the invention is now described starting from the moment in which a reel 2 has been transferred, by means of the arm 9 of the changing device 8, to the normal unrolling position in the packaging machine 1, leaving the receiving position 11 empty.

The distribution element 15, which retains the row of reels 2 in the magazine 3, is rotated into the position **15*b*, so that its front portion 15*a* moves below the inclined plane 4, allowing the first reel 2*a* to descend to the removal position 14; simultaneously, the rear end of the distribution element 15** rises, retaining the subsequent reel of the row.

In the removal position 14, the reel **2*a* is supported by the supporting element 18 of the transfer means 17 which, at that time, is at said removal position 14**.

The transfer means 17 are then actuated so as to move the reel supporting element 18 downward along the guide 19. After the reel 2 has been transferred onto the rollers 20' in the receiving position 11, said reel is preset for being engaged by the head 10 of the arm 9 of the reel changing device 8; the reel is removed by the arm 9 and moved to the position 12 for normal unrolling when the preceding reel ends.

Figure 2:
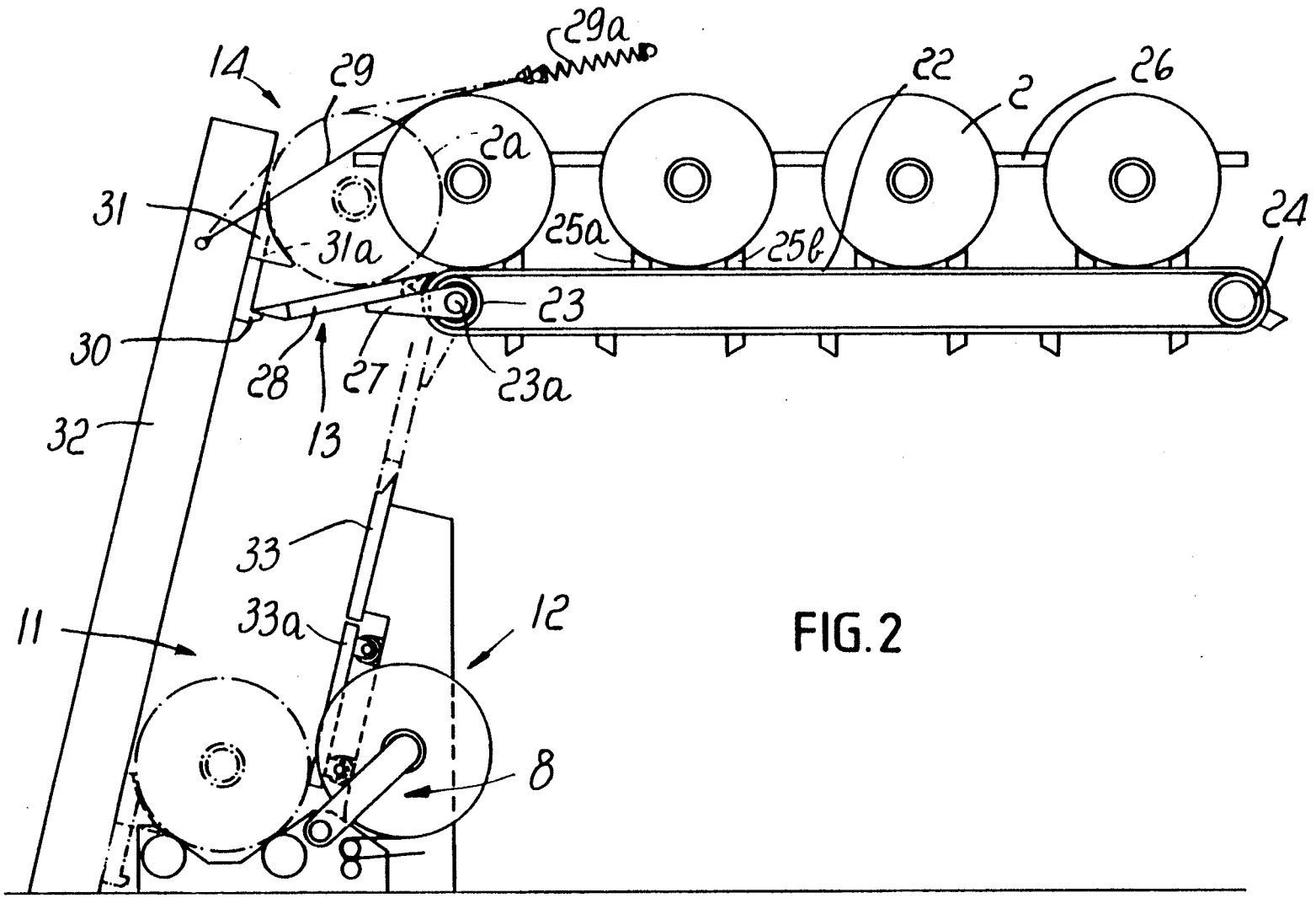
FIG. 2 is a side view of a different embodiment of the feeding device.

FIG. 2 illustrates a different embodiment of the feeding device, wherein the reels 2 advance in the buffer magazine by means of a conveyor belt 22; said belt 22 extends in a horizontal direction and winds around a pair of pulleys 23, 24, respectively a front one and a rear one.

Said belt 22 has, on its surface directed outward, pairs of teeth **25*a*, 25*b* which are uniformly spaced and are suitable for acting as support for individual reels 2; said reels 2 are supported with their axis transverse to the belt 22**.

Said reels 2 are furthermore guided, during their advancement on the belt 22, by lateral guides 26 (only one of which is illustrated in FIG. 2).

The fork-like coupling 27 of an element 28 for supporting the reel in the removal position 14 is pivoted at the axis **23*a* of the front pulley 23; said element is constituted by a plate which acts as bridge for the reel 2*a* which leaves the belt 22. The descent of the reel 2*a* along the supporting plate 28 is braked by a tape 29 which is conveniently sprung by means of a shock-absorbing element 29*a* and is suitable for engaging the peripheral surface of said reel 2*a*. The supporting plate 28 and the resiliently urged tape 29 constitute distribution means which are generally indicated by the reference numeral 13 and are adapted for guiding the reel 2*a* into the removal position 14**.

The supporting plate 28 is supported, at its free end, in the removal position 14, by a lower tab 30 of elements for transferring the reel **2*a*. Said transfer elements have an element 31 for bearing the reel to be fed; said supporting element 31 can move, under the control of actuation means which are not illustrated, along a guide element 32 arranged in front of the magazine 3 and inclined forward in the direction of advancement of the reels 2**.

The supporting plate 28 is furthermore subjected to the action of spring means, not illustrated, which are suitable for returning it to the raised position.

When the transfer means are actuated so as to lower the reel supporting element 31 along the guide 32, the supporting plate 28 rotates downward under the weight of the reel 2 to a position in which it is aligned with an underlying wall 33 facing said guide 32.

A reel guiding channel is defined between the guide 32 and the wall 33; said reel descends to the receiving position 11 along said channel.

After the passage of the reel, the supporting plate 28 is returned upward by said spring means. The supporting element 31 is affected by a vertical slot **31*a* which is suitable for allowing the ascent of said supporting element 31 back into the removal position 14 without interference with the plate 28. A portion 33*a* of the wall 33 can slide laterally to allow the removal and movement of the reel 2 into the normal unrolling position 12 performed by the changing device 8**.

Figure 3:
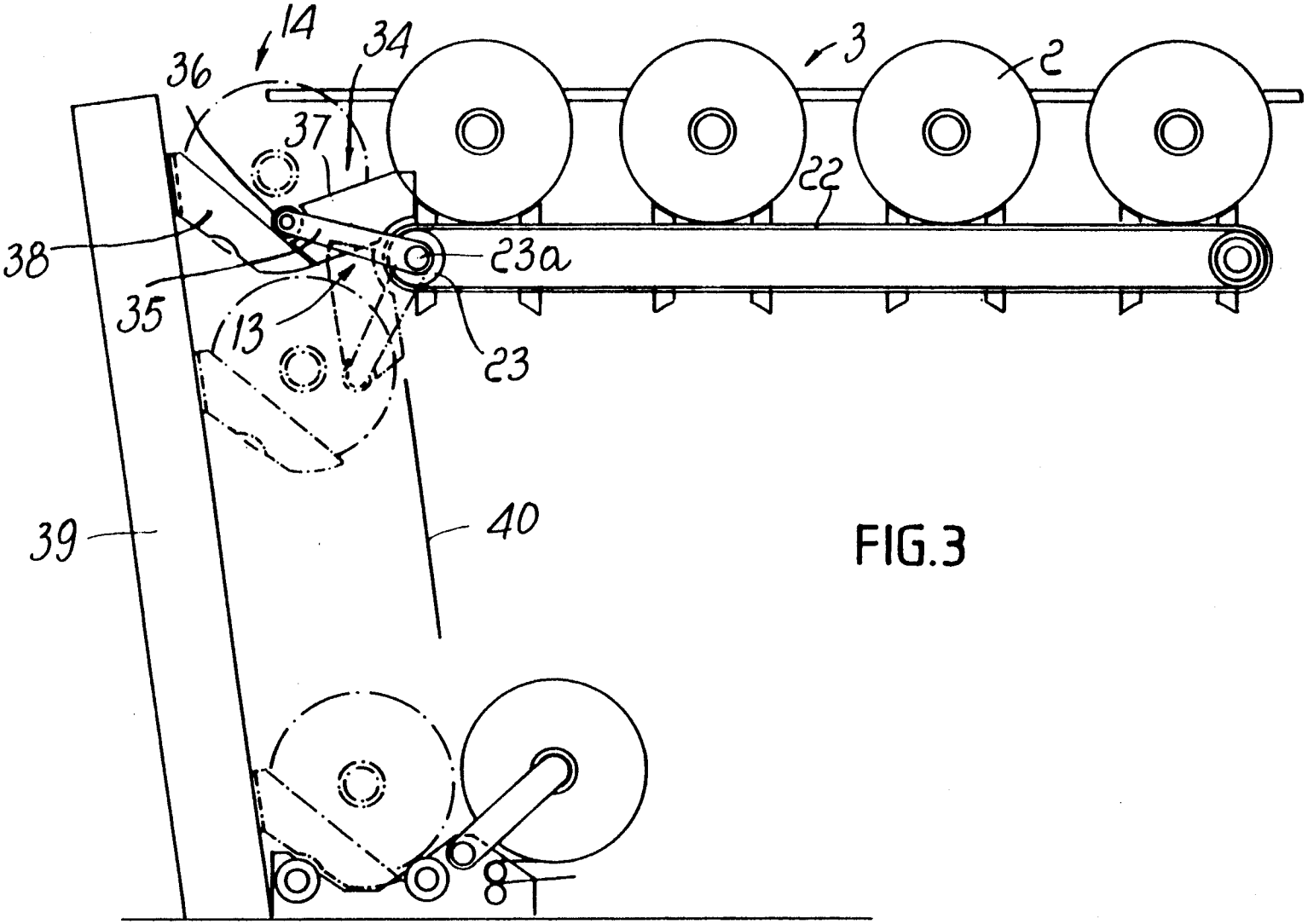
FIG. 3 is a side view of a further embodiment of the feeding device.

FIG. 3 illustrates a further embodiment of the feeding device, wherein said conveyor belt 22 feeds distribution means, generally indicated by 13, which comprise a supporting element 34 constituted by a fork or fork-like element 35 which is pivoted at the axis **23*a* of the front pulley 23. The two prongs of said fork 35 are coaxially provided, at their ends, with respective protruding rollers 36, and have respective shoulders 37**.

The fork 35 can rotate between a raised position, wherein it is suitable for supporting the reel 2 in the removal position 14 so as to rest, by means of the rollers 36, on a supporting element 38 of the means for transferring the reel 2, and a lowered position which is suitable for the passage of said reel 2. The fork 35 is subjected to the action of spring means, not illustrated, which are suitable for returning it to the raised position.

The supporting element 38 can move, under the control of actuation means which are not illustrated, along a guide 39 arranged in front of the magazine 3 and inclined backward with respect to the direction of advancement of the reels 2. The rotation of the fork 35 in the lowered position is allowed when the transfer means are actuated so as to move the supporting element 38 downward.

It should be noted that the shoulders 37 of the fork 35 continue to laterally guide the reel 2 for part of the descent of said reel in the channel defined between the guide 39 and an opposite wall 40.

Figure 4:
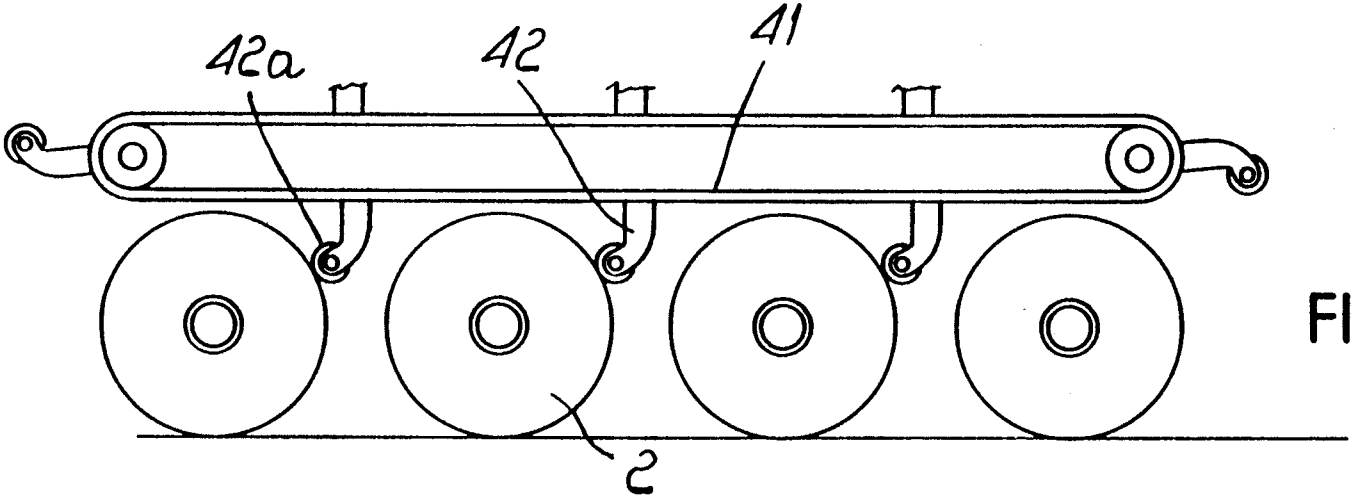
FIG. 4 is a detail view of the reel buffer magazine in a further embodiment.

Alternatively, it is possible to provide the advancement of the reels 2 along the buffer magazine of the device by means of an upper conveyor belt 41 provided with teeth 42 intended to engage individual reels 2 with a roller **42*a*, as illustrated in FIG. 4**. In this case the bottom of the magazine is constituted by a horizontal plane.

Figure 5:
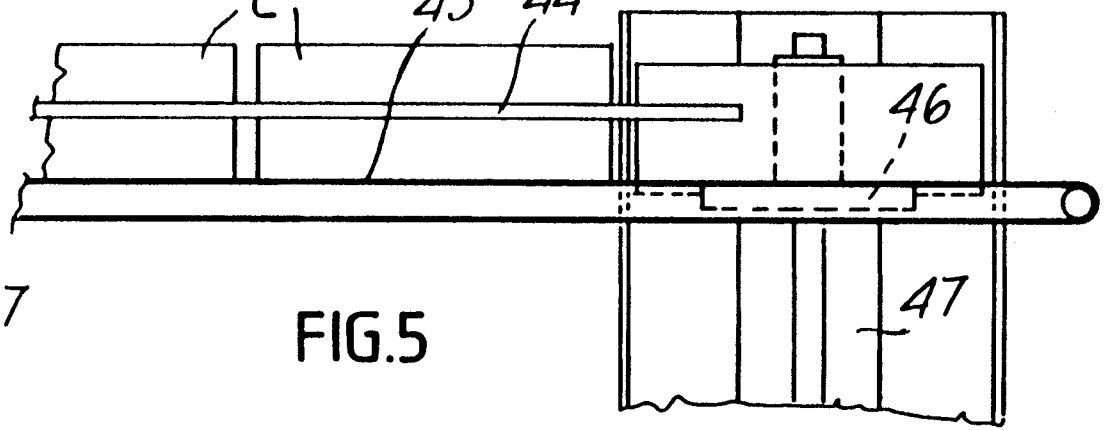
FIGS. 5 and 6 are respectively a side view and a front view of a device for feeding reels having a particular shape.
Figure 6:
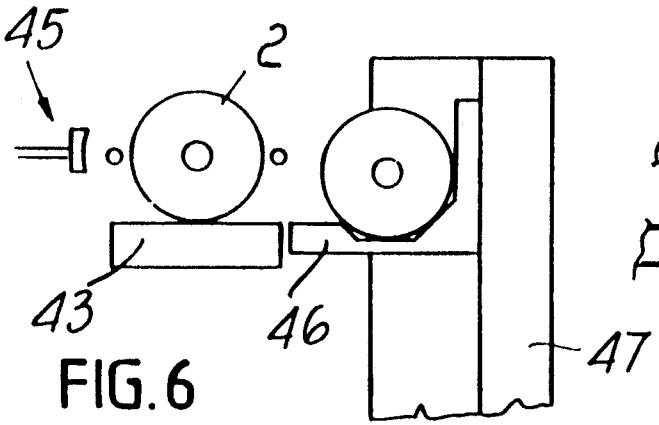

FIGS. 5 and 6 finally illustrate an embodiment of the device intended for use with reels having an axially elongated shape. Said reels are arranged so as to be axially aligned and close to one another on a conveyor belt 43 of the buffer magazine. The belt is flanked by lateral guides 44.

A pusher element 45 is arranged at the front end of the magazine and is suitable for moving the first reel of the row laterally. The moved reel is pushed onto a supporting element 46 which is arranged in front of the pusher 45 on the opposite side of the belt 43. The supporting element 46 can move on a vertical guide 47 at the base of which the reel changing device is arranged.

In the practical embodiment of the present invention, the materials employed, as well as the shapes and dimensions, may vary according to the requirements.

I claim:

1. Device for feeding reels of tape material into a packaging machine comprising:

a buffer magazine for said reels, along which said reels are advanced after one another;

distribution means for guiding a first one of said reels into a removal position;

transfer means for transferring said reels one after the other from said removal position to an underlying receiving position;

a reel guiding channel for guiding said reels being transferred by said transfer means from said removal position to said receiving position, said reel guiding channel comprising a guide element arranged in front of said buffer magazine;

a device for changing the reel to be unrolled in the packaging machine being arranged at said receiving position;

wherein said distribution means comprises an element for supporting said first reel in said removal position, said element being pivoted at a first end thereof to said buffer magazine for acting as a bridge to support said first reel as it descends from said buffer magazine to said transfer means, and said transfer means comprises an element for bearing said first reel in said removal position, said bearing element being provided with a lower tab for supporting in said removal position a second end of said supporting element which is opposite to said pivoted first end thereof, said bearing element being movable along said guide element of said reel guiding channel.

2. Device according to claim 1, wherein said buffer magazine comprises a conveyor belt which extends in a substantially horizontal direction between front and rear pulleys, said belt having on an outer surface thereof, pairs of uniformly spaced teeth adapted for supporting individual reels, said reels being each supported with their axes arranged transversely to said belt.

3. Device according to claim 1, wherein said distribution means further comprises a tape which resiliently engages the peripheral surface of said first reel for braking the descent thereof along said supporting element acting as a bridge, said tape being adapted for guiding said first reel into said removal position.

4. Device according to claim 1, wherein said supporting element is adapted for downward rotation to a position in which it is aligned with an underlying wall facing said guide element, said downward rotation of said supporting element occurring under the weight of said first reel and upon downward movement of said bearing element along said guide element.

5. Device according to claim 4, wherein said guide element arranged in front of said buffer magazine and said wall facing said guide element define said reel guiding channel.

6. Device according to claim 5, wherein a portion of said wall is slideable for allowing a movement of said reel from said receiving position into a normal unrolling position, said movement of said reel being performed by said device for changing the reel to be unrolled.

7. Device according to claim 4, wherein said supporting element is spring-actuated for raising from said position in which is aligned with said wall, to a raised position for guiding in said removal position a further reel from said buffer magazine.

* * * * *